US010407826B2

(12) United States Patent
Rymer

(10) Patent No.: US 10,407,826 B2
(45) Date of Patent: Sep. 10, 2019

(54) DETACHABLE FLYER BOW SYSTEM, APPARATUS AND METHODS OF USING SAME

(71) Applicant: Roy R. R. Rymer, Welland (CA)

(72) Inventor: Roy R. R. Rymer, Welland (CA)

( * ) Notice: Subject to any disclaimer, the term of this patent is extended or adjusted under 35 U.S.C. 154(b) by 0 days.

(21) Appl. No.: 14/941,849

(22) Filed: Nov. 16, 2015

(65) Prior Publication Data

US 2017/0137994 A1 May 18, 2017

(51) Int. Cl.

| | |
|---|---|
| ***D07B 3/10*** | (2006.01) |
| ***B21F 7/00*** | (2006.01) |
| ***D01H 7/26*** | (2006.01) |

(52) U.S. Cl.

CPC ..... *D07B 3/103* (2013.01); *B21F 7/00* (2013.01); *D01H 7/26* (2013.01); *D07B 2501/406* (2013.01)

(58) Field of Classification Search

CPC ..... D07B 3/00; D07B 3/103; D07B 3/106; D07B 7/02; D07B 7/022; D07B 7/04; D07B 7/06; D01H 7/26; D01H 7/40; B21F 7/00

USPC ..... 57/115

See application file for complete search history.

(56) References Cited

U.S. PATENT DOCUMENTS

| | | | | | |
|---|---|---|---|---|---|
| 453,269 | A * | 6/1891 | Smith | D01H 7/26 | 228/155 |
| 1,371,261 | A * | 3/1921 | Price | A01K 87/00 | 43/18.1 R |
| 1,646,550 | A * | 10/1927 | Miller | B21F 1/06 | 140/73 |
| 1,684,511 | A * | 9/1928 | O'Donnell | D07B 3/10 | 57/58.68 |

(Continued)

FOREIGN PATENT DOCUMENTS

| | | |
|---|---|---|
| CA | 2556952 C | 8/2004 |
| CA | 2599042 C | 9/2006 |

(Continued)

OTHER PUBLICATIONS

Keir Manufacturing, Flyer Bow Components, "http://keirmfg.com/products/wire-cable-2/flyer-bow-components/" (2018) 4 pgs.

(Continued)

*Primary Examiner* — Shaun R Hurley
*Assistant Examiner* — Bao-Thieu L Nguyen
(74) *Attorney, Agent, or Firm* — Kagan Binder, PLLC

(57) ABSTRACT

A detachable flyer bow system, apparatus and methods of using the same are provided. The systems each comprise a base having a longitudinal recess with an inner lateral dimension that is greater than the outer lateral dimension and a front lateral dimension that is smaller than the rear lateral dimension, an end block attachable to the end of the flyer bow with a recess engagement portion to slidably engage the longitudinal recess of the base. The base may (Continued)

have an opening to allow at least a portion of the end block to clear the opening for the inward insertion of the end block into the base, or the outward removal of the end block from the base. Methods for securing a flyer bow to a wire twisting machine, methods of attaching a flyer bow to an end block, and flyer bows in combination with end blocks are also provided

15 Claims, 12 Drawing Sheets

(56) References Cited

U.S. PATENT DOCUMENTS

| | | | | | |
|---|---|---|---|---|---|
| 1,684,533 | A * | 9/1928 | Bouvier | D01H 1/101 | 57/13 |
| 1,690,373 | A * | 11/1928 | Marchev | D07B 3/02 | 57/58.52 |
| 2,593,984 | A | 4/1952 | Clary, Jr. et al. | | |
| 2,599,356 | A | 6/1952 | Wild | | |
| 2,689,447 | A | 3/1954 | Bruestle | | |
| 2,739,623 | A * | 3/1956 | Wirt | B21F 7/00 | 140/149 |
| 2,773,344 | A * | 12/1956 | Van Hook | D01H 1/101 | 242/130 |
| 3,147,580 | A * | 9/1964 | Ensor | D07B 3/10 | 57/58.52 |
| 3,309,857 | A * | 3/1967 | Haugwitz | D07B 3/10 | 57/58.36 |
| 3,390,552 | A * | 7/1968 | King | D04B 1/26 | 57/90 |
| 3,446,001 | A * | 5/1969 | Akachi | D07B 3/00 | 57/138 |
| 3,793,819 | A * | 2/1974 | Madalozzo | D07B 3/10 | 57/58.52 |
| 3,945,182 | A | 3/1976 | Dover et al. | | |
| 4,072,003 | A | 2/1978 | Mino | | |
| 4,235,070 | A | 11/1980 | Bravin | | |
| 4,393,647 | A * | 7/1983 | Kitamura | B65H 63/0327 | 200/61.18 |
| 4,471,161 | A * | 9/1984 | Drummond | D07B 3/10 | 174/110 R |
| 4,896,495 | A * | 1/1990 | Sperling | D07B 7/06 | 242/129.6 |
| 4,953,350 | A * | 9/1990 | Schulz | D01H 7/68 | 57/115 |
| 5,509,260 | A * | 4/1996 | Derdeyn | D01H 7/26 | 57/115 |
| 6,141,948 | A * | 11/2000 | Brazeau | D07B 3/10 | 242/364.12 |
| 6,209,299 | B1 | 4/2001 | Landry et al. | | |
| 6,286,294 | B1 | 9/2001 | Suzuki | | |
| 6,289,661 | B1 * | 9/2001 | Boland | D07B 3/10 | 57/115 |
| 6,385,955 | B1 * | 5/2002 | Rowlands | D07B 3/10 | 57/352 |
| 6,435,496 | B1 | 8/2002 | Phillips | | |
| 6,789,295 | B1 | 9/2004 | Svensson | | |
| 6,865,875 | B2 * | 3/2005 | Watkins | D07B 3/10 | 57/115 |
| 7,121,076 | B2 * | 10/2006 | Priegelmeir | D07B 3/103 | 57/118 |
| 8,662,113 | B2 * | 3/2014 | Bell | D07B 3/10 | 140/1 |
| 2001/0032448 | A1 | 10/2001 | Doherty | | |
| 2004/0172932 | A1 | 9/2004 | Watkins | | |

FOREIGN PATENT DOCUMENTS

| | | | |
|---|---|---|---|
| CN | 102797082 | A | 11/2012 |
| CN | 103219094 | A | 7/2013 |
| EP | 0254555 | B1 | 6/1991 |
| EP | 1784841 | A1 | 5/2007 |
| WO | 2004/011354 | A2 | 2/2004 |
| WO | 2006/010586 | A1 | 2/2006 |
| WO | 2012/164367 | A1 | 12/2012 |

OTHER PUBLICATIONS

Expometals.net® by Dell'Oro di Dell'Oro Davide, Carbon Fiber Bows, "http://www.expometals.net/en-gb/product-detail-heinze-streng-gmbh/carbon-fiber-bows" (Copyright(c) 2001-2009) 2 pgs.

Tiezhong Chi, Double twist bunching machine, "http://www.youtube.com/watch?v=27v_ujjx6yk" Published on Aug. 15, 2012, (video 54 seconds) 1 pg.

mechanicaldesign.asmedigitalcollection.asme.org/data/Journals/JMDEDB/27745/008301j.1.jpeg, printed Jun. 2019, 1 pg.

heinze-streng., WIDE SR—weniger B gelbruch durch optimierte Herstellungsprozesse, http://www.heinze-streng.com/wide-sr-2014.html, (2014), 2 pgs.

http://www.noga.com/images/new concept sketch.JPG, (2015), 1 pg.

Connek, Assembly guide, http://www.econnek.com/index.cfm?event=Assembly-Guide, (2012), 1 pg.

Amazon Supply, Bryant 52517 Conveyor Take-Up Tensioner with Quick Release Handle, Stainless Steel, 9" Adjustment, 1-1/8"-1-3/4" Bore, http://www.amazonsupply.com/bryant-conveyor-tensioner-stainless-adjustment/dp/B0099SA0YU, (2013), 2 pgs.

* cited by examiner

DETACHABLE FLYER BOW SYSTEM, APPARATUS AND METHODS OF USING SAME

FIELD OF THE INVENTION

The invention relates to systems and methods for detachably securing flyer bows to wire twisting machines.

BACKGROUND OF THE INVENTION

Wire twisting machines that use flyer bows are well known in the art and are commonly used to manufacture twisted wire or cable for a wide variety of applications, including those in the telecommunications and power distribution industries. Wire twisting machines are a class of machines for manufacturing wire or cable, are also referred to as winding, stranding, spinning, cabling, bunching, and twinning machines.

Wire twisting machines create twisted wire by feeding one or more wires from a source along the length of a flyer bow, rotating the flyer bow about a rotational axis, and collecting the finished, twisted wire. Typically, two flyer bows are used in a single machine, but more may be used depending on the application. In operation, a flyer bow can rotate at speeds up to 3,500 rpm and tangential speeds of up to 900 km/h. In operation, a flyer bow may fail due to any number of reasons, including wear and tear, product defect, or external factors including fluctuating wire tension, wire breakage, excessively fast start-up or shut-down of the machine, excessive vibration of the machine, improper balancing, foreign objects left inside the machine that collide with the bow, and human error in the set up or operation of the machine. A flyer bow failure often results in wire becoming entangled in the machine, resulting in costly downtime, scrap, repairs to the machine, and failure of other flyer bows in the machine. Downtime on the machine in which the failure has occurred is likely to cause downtime in downstream manufacturing processes, such as further twisting operations and jacketing operations.

A flyer bow is typically a flexible, convex, arcuate member that guides one or more wires along the length of the inside surface of the flyer bow. Existing flyer bows are typically removable from wire twisting machines for service or replacement and are typically secured to wire twisting machines using fasteners. Typically, each end of the flyer bow has holes to accept one or more fasteners, which align with holes in the wheels of the machine. Fasteners are commonly inserted through the holes of the flyer bow and secured to the machine to hold the flyer bow in place. The steps to replace such a flyer bow include: removing all of the fasteners, removing the flyer bow, aligning the holes of a first end of the replacement flyer bow with the holes of a wheel of the machine, inserting fasteners at that first end, and then, simultaneously: flexing and straightening the replacement flyer bow, aligning holes of the flyer bow at its second end with the holes of the machine's other wheel, and inserting the fasteners at that other end.

Typically, flyer bows are attached to the wheels of a machine using clamp blocks actuated by threaded fasteners to secure an end of the flyer bow to a wheel. The steps to replace a flyer bow include loosening or removing the fasteners, removing the flyer bow, aligning a first end of the replacement flyer bow with respect to a first wheel, tightening or replacing the fasteners at that first end, and simultaneously: straightening and flexing the replacement flyer bow, aligning a second end of the replacement flyer bow with respect to a second wheel and tightening or replacing the fasteners at that second end.

A disadvantage of such apparatus is that fasteners such as nuts, bolts and screws are required to secure the flyer bow to the wheel. The replacement of a flyer bow using fasteners is time consuming, because each fastener must be replaced or tightened.

Another disadvantage is that replacement of flyer bows with fasteners is cumbersome. As described above, the flyer bow must be simultaneously straightened, flexed, aligned and fastened. Multiple workers may be needed to replace a flyer bow using fasteners, for a single worker typically lacks the strength, coordination and dexterity needed to perform these steps simultaneously.

A further disadvantage of the apparatus is that in operation, a foreign object such as a stray fastener or fastener tool may be left inside the machine, become dislodged and collide with the flyer bow. This may cause failure or damage to the flyer bow and the machine, and possibly even personal injury or death of a person located close to the machine.

A flyer bow failure in a machine with multiple flyer bows will usually cause the one or more other flyer bows to fail in that machine. Thus the costs of replacement, labour and time associated with the using fasteners in the replacement of a flyer bow and potential risk of injury tend to multiply with the number of flyer bows in a given machine.

SUMMARY OF THE INVENTION

A system for securing a flyer bow to a wheel of a wire twisting machine is provided. The system has a base that is sized and can be fixed to the outer surface of the wheel, an end block that is attachable to an end of the flyer bow which slidably engages with the base. The base has a longitudinal recess having an inner lateral dimension and an outer lateral dimension, the inner lateral dimension being greater than the outer lateral dimension, a front lateral dimension and a rear lateral dimension, the front lateral dimension being smaller than the rear lateral dimension. The end block has a recess engagement portion that slidably engages the longitudinal recess. The end block may be disposed to cooperatively wedge within the longitudinal recess. The longitudinal recess of the base may have a dovetail shaped cross sectional profile.

The base may also have an opening that is sized to allow the end block to clear the base for inward insertion of the end block into the base or outward removal of the end block from the base when the end block is spaced away from the front of the base. If the opening of the base is located between the front and back sides of the base, the end block will have a notch located between its front and back sides that is sized to clear at least a portion of the base between the opening and back side of the base.

The system may also have a stop that is removably attached to the base that physically blocks the end block from moving backward relative to the base. The stop can be a plate that is rotatably coupled to the base.

A flyer bow is provided having two end blocks having the features of end blocks described above.

A method of securing a flyer bow to a wire twisting machine is provided, where the flyer bow has two end blocks, one at each end of the flyer bow, and the machine has two opposing wheels with an end block attached to each wheel. The method steps include slidably engaging an end block with a base, moving the end blocks apart, slidably engaging the other end block with the other base, and moving the end blocks together. The end blocks may be slidably engaged with their respective bases by cooperatively wedging the end blocks with the bases. If the base contains an opening and the end block contains a notch as described above, before the step of slidably engaging each end block with its respective base, the end block and the base are first aligned to allow them to clear each other and the end block is then inwardly inserted into the base. Optionally, the end blocks may be physically blocked from moving in the backward direction. This step may include rotating a plate relative to each base to physically block the end blocks.

A method for attaching an end block to an end of a flyer bow is also provided. The method steps include providing a flyer bow and an end block, applying an adhesive to one or both of the flyer bow and end block, and allowing the adhesive to bond the flyer bow and the end block.

BRIEF DESCRIPTION OF THE FIGURES

The drawings illustrate several embodiments of the invention.

DETAILED DESCRIPTION

Several embodiments of the invention are described below in the following examples.

A wire twisting machine has two opposing wheels each having a common rotational axis and an outer surface. A flyer bow attached to the wheels guides wire moving from a source along the length of the flyer bow and rotates about the axis of the wheels, typically at high speeds, to twist the wire.

The systems disclosed herein are used to secure a flyer bow to a wheel of a wire twisting machine. The systems include a base that is attached to the outer surface of a wheel and an end block that is attachable to the end of a flyer bow and slidably engages with the base. Optionally, a system may comprise a stop to prevent backward movement of the end block relative to the base. The base has a front side, a back side, an inner side, and an outer side. In this specification, the inner side is the side closest to the outer surface of the wheel and the outer side is the side furthest away from the outer surface of the wheel. The front side is the side closest to the centre of the machine. The direction from the back side to the front side is the "frontward direction" as shown by the arrow in FIG. 1, and generally points to the centre of the machine. The term "length" when used to describe a size of the base or the end block refers to the size along the frontward direction. The direction from the inner side to the outer side is the "outer direction". The term "height" when used to describe a size of base or the end block refers to the size along the outward direction. The direction perpendicular to the frontward direction and the outer direction is the "lateral direction". The term "width" when used to describe a size of the base or the end block refers to a size along the lateral direction.

Figure 1A:
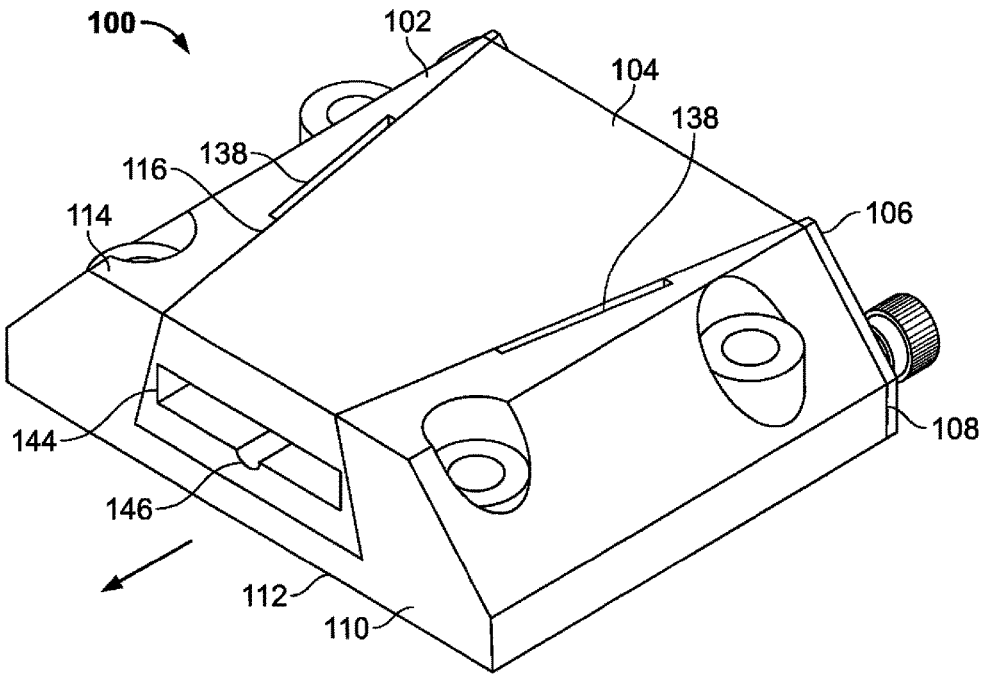
FIG. 1*a* is a perspective view of an embodiment of a base, an end block and stop in an assembled configuration.
Figure 1B:
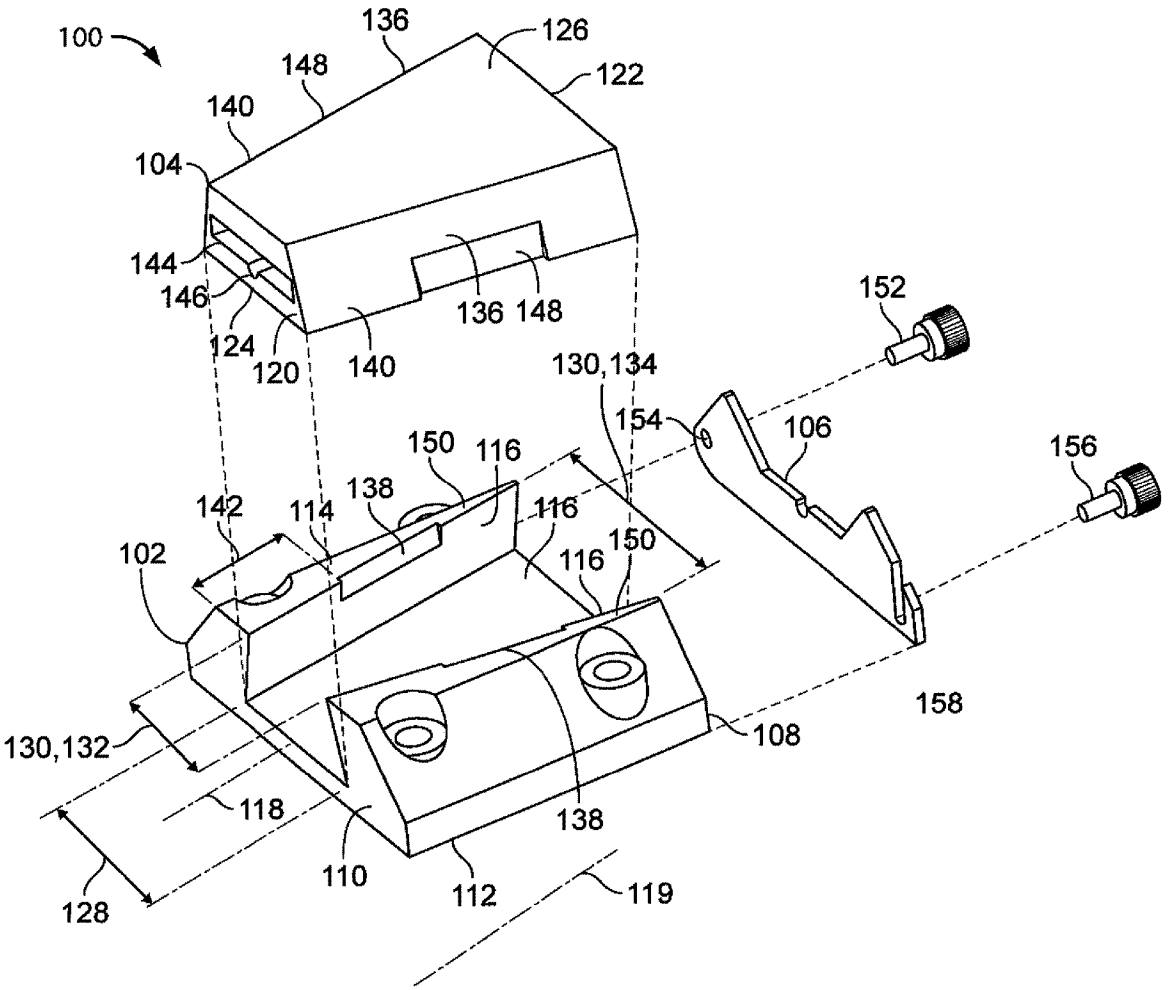
FIG. 1*b* is an exploded perspective view of the embodiment in FIG. 1*a*.
Figure 1C:
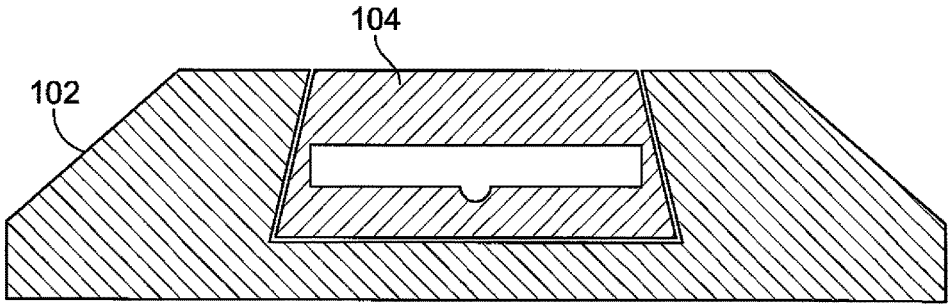
FIG. 1*c* is a cross sectional view of the base of the embodiment in FIGS. 1*a* and 1*b*.

In FIGS. 1*a* and 1*b*, system 100 includes base 102 having back side 108, a front side 110, an inner side 112, and an outer side 114 that contains longitudinal recess 116, an end block 104 and a plate 106. The center of the width of recess 116 defines a longitudinal axis 118. Inner side 112 of the base is sized and can be fixed to the outer surface of the wheel such that the longitudinal axis 118 of recess 116 and the rotational axis of the wheel 119 (wheel not shown) are substantially coplanar. Thus, the system and the flyer bow can be aligned with the axis of rotation of the wheels.

Figure 2A:
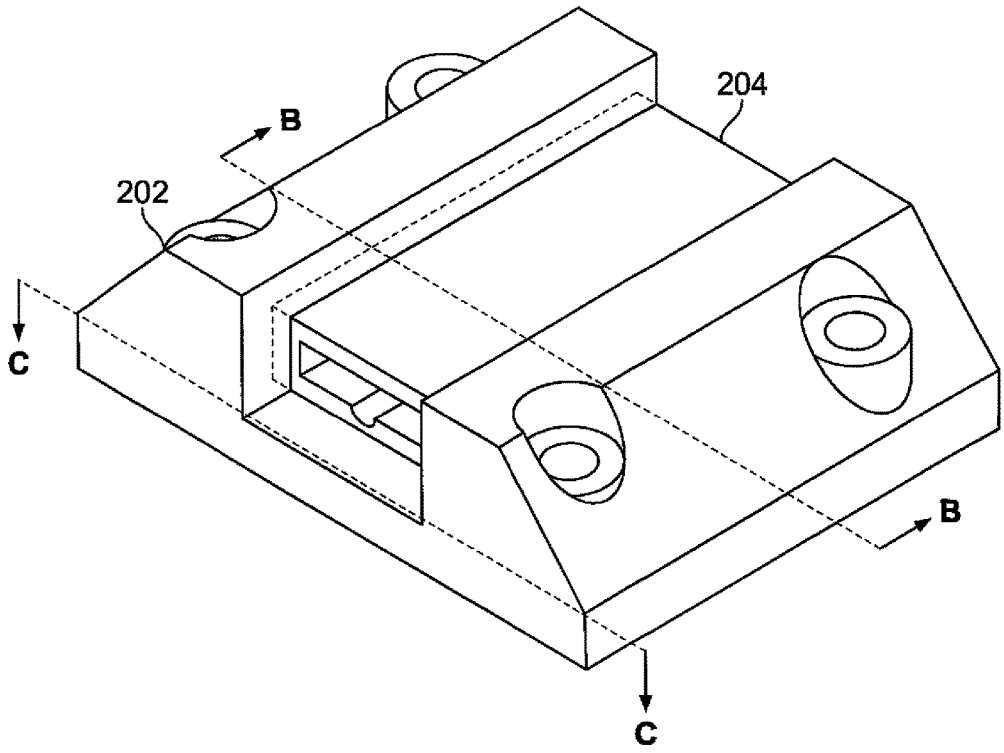
FIG. 2*a* is a perspective view of yet another embodiment of a base and an end block in an assembled configuration.
Figure 2B:
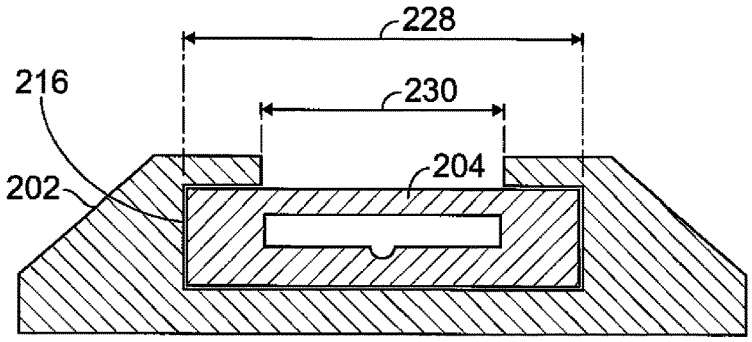
FIG. 2*b* is a cross sectional view of the base and block of FIG. 2*a* in assembly shown along line A-A.
Figure 3A:
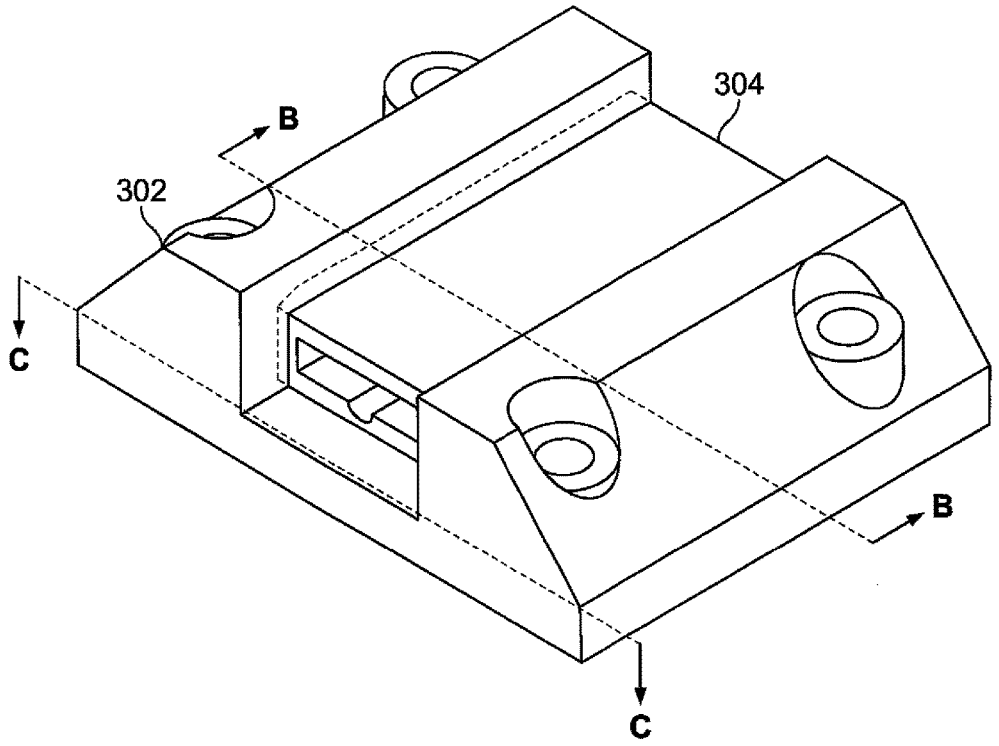
FIG. 3*a* is a perspective view of still another embodiment of a base and an end block in an assembled configuration.
Figure 3B:
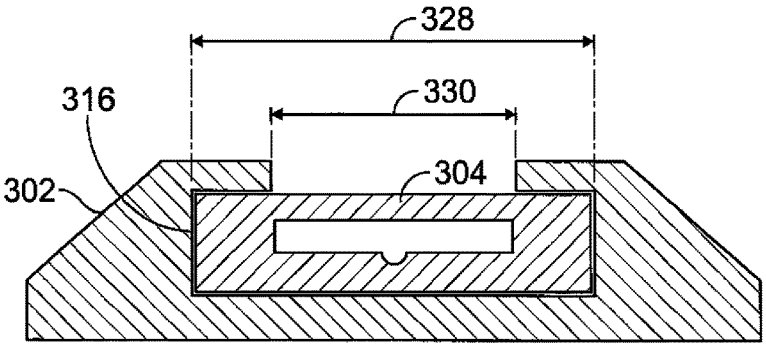
FIG. 3*b* is a cross sectional view of the base and block assembly shown along line C-C.

In at least one position along its length, the longitudinal recess has an inner lateral dimension and an outer lateral dimension, the inner lateral dimension is greater than the outer lateral dimension. The longitudinal recess retains the end block within the base and prevents it from moving in the outward and forward directions. That outward retention is caused by the longitudinal recess having a difference in size between the smaller inner lateral dimension and the larger outer lateral dimension. In FIG. 1*b,* at the front end of the base, longitudinal recess 116 has an inner lateral dimension 128 and an outer lateral dimension 130. The inner lateral dimension 128 is greater than the outer lateral dimension 130. Likewise, FIG. 2*b* shows another embodiment having a longitudinal recess 216 with an inner lateral dimension 228 that is greater than outer lateral dimension 230. Similarly, FIG. 3*b* shows yet another embodiment having a recess 316 with an inner lateral dimension 328 that is greater than outer lateral dimension 330.

Figure 2C:
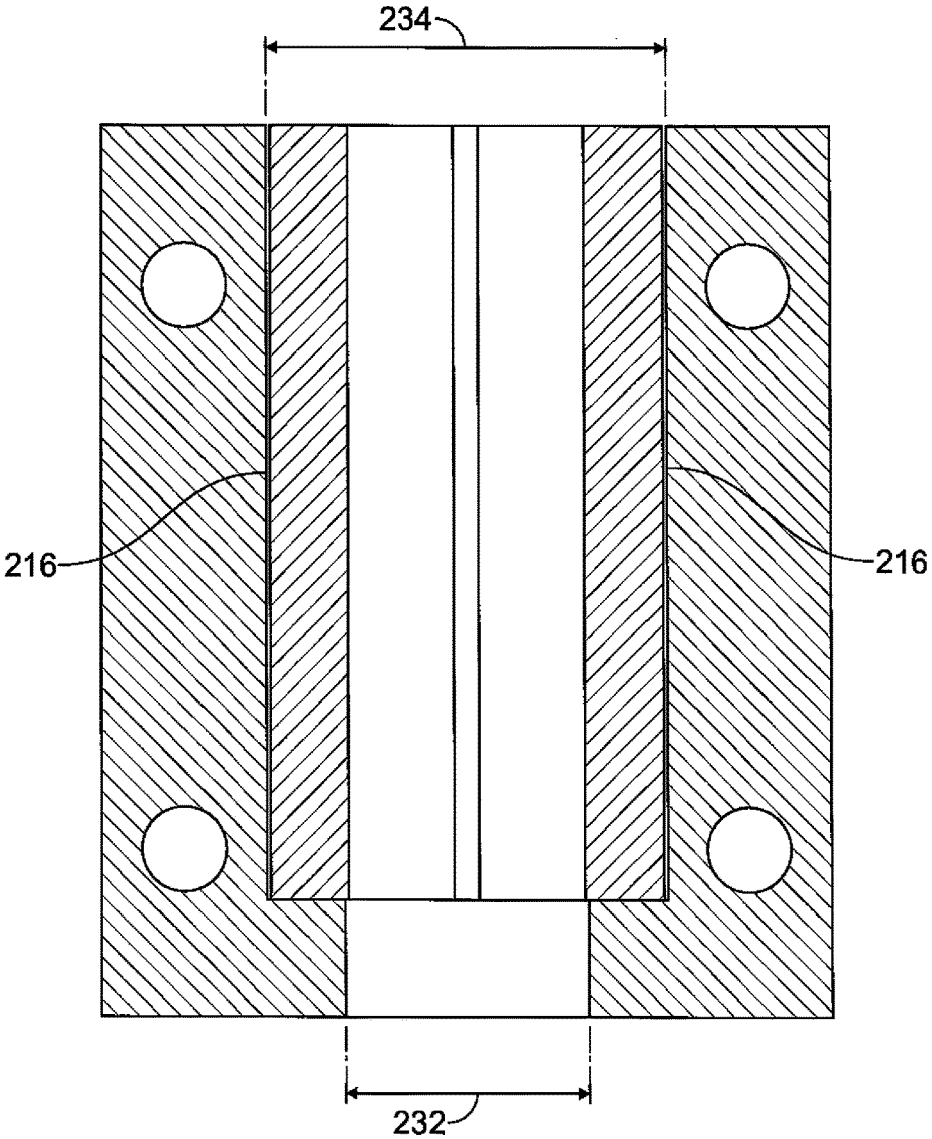
FIG. 2*c* is a cross sectional view of the base and the block of FIG. 2*a* in assembly shown along line B-B.
Figure 3C:
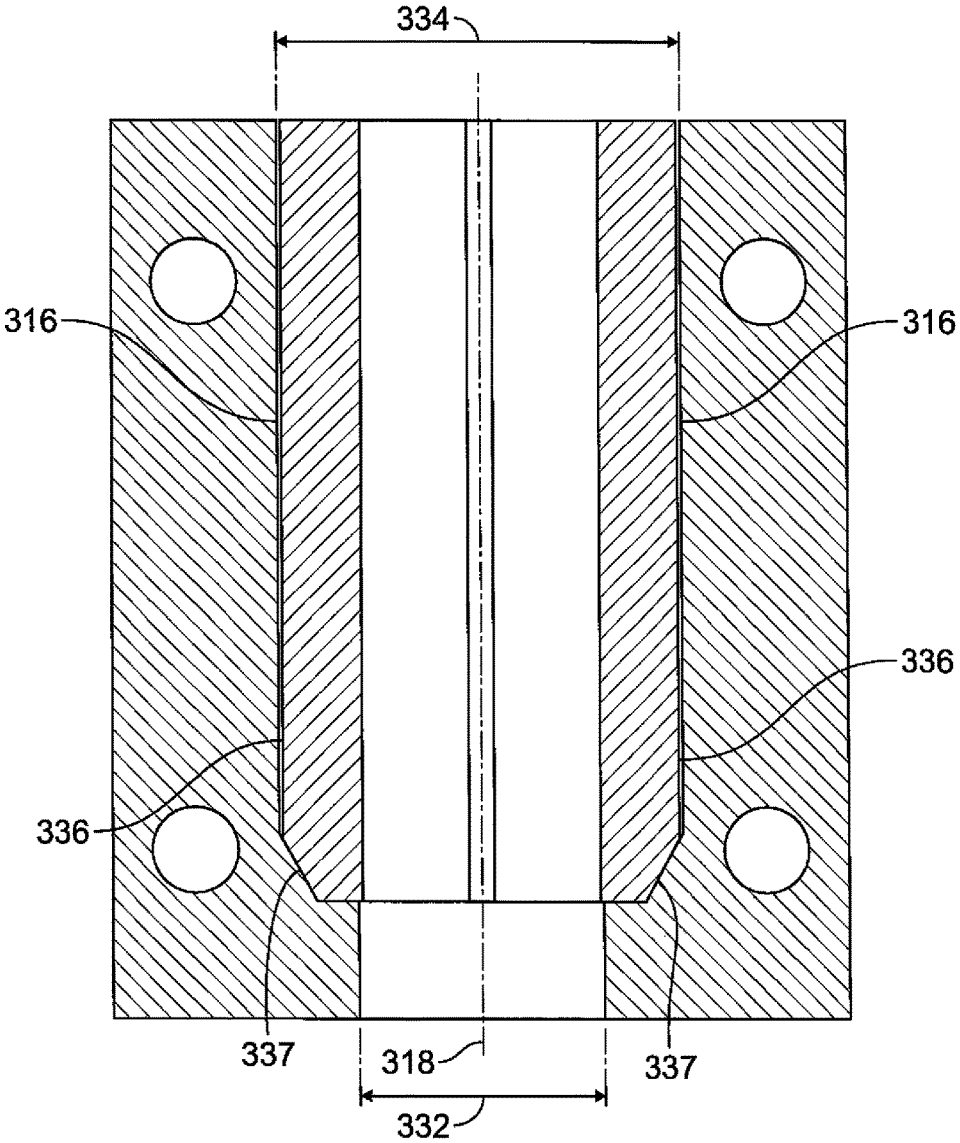
FIG. 3*c* is a cross sectional view of the base and the block of FIG. 2*a* in assembly shown along line D-D.

At a given height of the longitudinal recess, the recess has a front lateral dimension and a rear lateral dimension, the front lateral dimension being smaller than the rear lateral dimension. The longitudinal recess retains the end block within the base and prevents it from moving in the outward and forward directions. The forward retention of the end block is caused by the difference in size between the smaller front lateral dimension and the larger rear lateral dimension. FIG. 1*b* shows front lateral dimension 132 (being the same as outer lateral dimension 130 in this embodiment) and rear lateral dimension 134, the front lateral dimension being smaller than the rear lateral dimension. FIG. 1*a* shows that in assembly, end block 104 is retained in respect of outward movement and frontward movement relative to base 102. Likewise, FIGS. 2*c* and 3*c* show other embodiments having recesses 216 and 316 each having a respective front lateral dimension 232 and 332 that is smaller than its respective rear lateral dimension 234 and 334. FIGS. 2*a*-2*c* and 3*a*-3*c* show that, in assembly, respective end blocks 204 and 304 are retained in respect of outward movement and frontal movement relative to respective bases 202 and 302.

The end block has a recess engagement portion. The recess engagement portion is disposed to slidably engage the longitudinal recess. Slidable engagement between the recess engagement portion and the longitudinal recess aligns the end block longitudinally with the base and retains the end block from outward and forward movement within the base. Slidable engagement between the end block and the base is created by sizing the recess engagement portion of the end block and longitudinal recess of the base with sufficient proximity to retain the end block within the base.

In FIG. 1*b,* end block 104 has a recess engagement portion 136. Recess engagement portion 136 is disposed to slidably engage the longitudinal recess 116 of base 102. The slidable engagement between the recess engagement portion 136 and the longitudinal recess 116 aligns the end block 104 longitudinally with base 102 and retains end block 104 from outward and forward movement relative to base 102. As shown in FIGS. 1*a*-3*c*, end bases 102, 202, 302 and respective end blocks 104, 204 and 304 assemble with a sliding fit.

As shown in FIGS. 1*a* and 1*b,* the recess engagement portion 136 may be disposed to cooperatively wedge within the longitudinal recess 116. In this specification, cooperative wedging means that at least part of the recess engagement portion 136 of an end block 104 and a corresponding part of the recess in assembly form a wedge shape. Cooperative wedging of the recess engagement portion 136 and the longitudinal recess 116 distributes forces acting in the forward direction on the end block 104 and base 102 in the lateral direction and over a larger contact area, thus reducing stress concentrations in the end block 104 and base 102. Cooperative wedging of the end block 104 and the base 102 may also assist alignment of the end block 104 and the base 102 during assembly. The wedge shape need not be symmetrical about the longitudinal axis of the end block 104 and base 102. For instance, an end block 104 and a base 102 could have a wedge shape on one side of the longitudinal axis but not on the opposite side of that axis.

As shown in FIG. 1*b,* recess engagement portion 136 of end block 104 form a wedge shape over the length of end block 104 that is symmetrical about longitudinal axis 118 of base 102. FIG. 3*c* shows recess engagement portion 336 forming wedge shape 337 over a portion of the length of end block 302 and base 304 that is symmetrical about longitudinal axis 318. The wedge shape may be positioned at the front of the end block to assist alignment of the end block with the base during assembly.

The cross sectional profile of the longitudinal recess may form a dovetail shape. A dovetail shape is symmetrical about the longitudinal axis of the base and distributes the outward forces acting on the end block and base in the lateral direction and over a larger contact surface, thus reducing stress concentration in the end block and base. FIGS. 1*a* and 1*b* show that longitudinal recess 116 and recess engagement portion 136 have a dovetail shape that is symmetrical about longitudinal axis 118.

As shown in FIGS. 1*a* and 1*b*, the outer side of the base 114 may have an opening 138 extending inwardly from the outer side of the base 114 and laterally from the longitudinal axis of the base 118. The opening 138 is sized to allow at least a portion 140 of the end block 104 to clear the opening 138 when that portion 140 of the end block 104 is aligned with opening 138 for inward insertion of the end block 104 into the base or outward removal of the end block 104 from the base. The opening 138 is spaced away from the front side of the base along the longitudinal axis 138 to provide for slidable engagement of the recess engagement portion 136 and the longitudinal recess at the front of the base. The opening 138 need not be symmetrical nor exist on both sides of the longitudinal axis 138. The opening 138 shortens the backward distance that the end block 104 must travel relative to the base 102 to align and slidably engage the recess engagement portion 136 with the longitudinal recess, thus reducing the amount of straightening and flexure the flyer bow must undergo during assembly or disassembly.

Reducing the amount of straightening and flexure of the flyer bow during assembly is advantageous because flyer bows typically have a curved shape which is difficult to straighten. By reducing the amount of straightening and flexure of the flyer bow, the opening 138 eases assembly and disassembly by reducing the amount of force required to be applied to the flyer bow in order to align and slidably engage the end block 104 with the base 102.

Optionally, the opening 138 may be located between the front side 110 of the base 102 and the back side 108 of the base 102. In that case, the end block 104 has a front side 120, a back side 122, an inner side 124 an outer side 126, and a notch 148. The notch 148 is sized to allow at least a portion 150 of the base 102 between the back side 108 of the base 102 and opening 138 to clear the notch 148 when a portion 150 of the base 102 is aligned with the notch 148, for inward insertion of the end block 104 into the base 102 or outward removal of the end block 104 from the base 102. The placement of the opening 138 between the front and the back end of the base 102 allows the recess engagement portion 136 and the longitudinal recess to engage both in front of the opening 138 and behind the opening, thus distributing the contact area between the recess engagement portion 136 and the longitudinal recess 116 along the lengths of the base 102 and the end block 104. Openings 138 and notch 148 allow the bow to be inserted or placed into the machine. Without these features, in certain circumstances, the tight tolerance of the parts might make it difficult or impossible to insert the bow.

In FIG. 1*b,* opening 138 appears on both sides of the longitudinal axis 118, extends inwardly from the outer side 114 of the base, and extends laterally from the longitudinal axis 118. Opening 138 is sized to allow at least a portion 140 of end block 104, appearing on both sides of longitudinal axis 118, to clear opening 138 when portion 140 of end block 104 is aligned with opening 138, for inward insertion of end block 104 into base 102 or outward removal of end block 104 from base 102. Opening 138 is spaced away at a distance 142 from the front side 110 of base 102 along longitudinal axis 118 to provide for slidable engagement of the recess engagement portion 136 within longitudinal recess 116 toward the front end 110 of the base 102. Opening 138 is located between front side 110 of the base and back side 108 of base 102. End block 104 has front side 120, back side 122, inner side 124, outer side 126 and notch 148 located between the front side 120 and the back side 122 of the end block 104. Notch 148 is sized to allow at least a portion 150 of the base between the back side 108 of the base 102 and opening 138 of base 102 to clear notch 148 of end block 104 when portion 150 of base 102 is aligned with notch 148 of end block 104, for inward insertion of end block 104 into base 102 or outward removal of end block 104 from base 102.

The end block is attachable to an end of a flyer bow. The end block is attachable by any means known in the art that can, in operation, sustain loads applied to the end block and prevent separation of the end block from the end of the flyer bow. Such known attachment means include adhesion and fastening. Several attachment means may be suitable, and the suitability of any such means will depend on operating conditions, the selection of material for the flyer bow, end block and base. The flyer bow may be attached to the end block by, for instance, providing a hole or a recess in the end block along its length to receive the flyer bow, applying an adhesive to any one or both of a portion of the end of the flyer bow and the end block inside the hole, contacting the end block on the inside of the hole with the portion of the end of the flyer bow, and allowing the adhesive to bond with the flyer bow and the end block. As a further example, the flyer bow may be attached to the end block by providing a hole or a recess in the end block along its length to receive the flyer bow and securing the end block to the flyer bow with fasteners, such as nuts and bolts, screws or rivets. FIGS. 1*a* and 1*b* show hole 144 that is adapted to receive an end of a flyer bow along the length of the end block for the purpose of attachment to the flyer bow. Hole 144 contains a clearance groove 146 running along the length of end block 104 to allow wire to pass from a source to the flyer bow.

In operation, the rotation of the flyer bow causes the flyer bow to exert lateral, forward and outward forces on the end block and the base. The end block and base can be made of any material suited to withstand those forces. A skilled person will appreciate that the suitability of a given material of an end block and base will depend on operating conditions, the material of the flyer bow, the means of attachment of the flyer bow to the end block. Many material selection options may exist for the end block and base for a given application and may include, for instance, steel, aluminum, composite materials and high strength plastics. In some embodiments, bases 102, 202 and 302 and end blocks 104, 204 and 304, as shown in FIGS. 1*a*-3*c* are made of Aluminum 6061.

The system may comprise a stop that is removably attached to the base. The stop physically blocks the end block from moving backward relative to the base when the stop is attached to the base and the recess engagement portion is engaged with the longitudinal recess. The recess engagement portion can be disengaged from the longitudinal recess when the stop is detached from the base. The stop may comprise a plate that is rotatably coupled to the base at a first position of the plate and is attachable to the base at a second position of the plate. In FIGS. 1*a* and 1*b,* plate 106 is rotatably coupled to base 102 using screw 152 at a first position 154 of plate 106 and is attachable to base 102 using screw 156 at a second position 158 of plate 106. End block 104 can be disengaged from base 102 by loosening screw 156, rotating the second position of the plate in the outward direction until end block 104 is free to move in the backward direction relative to base 104.

Figure 4A:
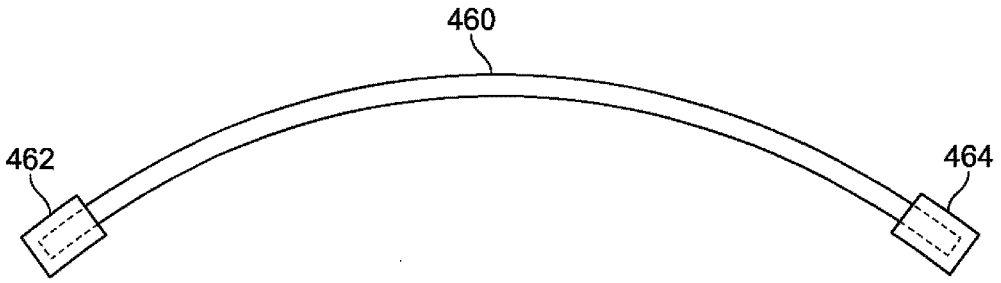
FIG. 4*a* is a side elevation view of an embodiment of a flyer bow comprising two end blocks attached to each end.
Figure 4B:
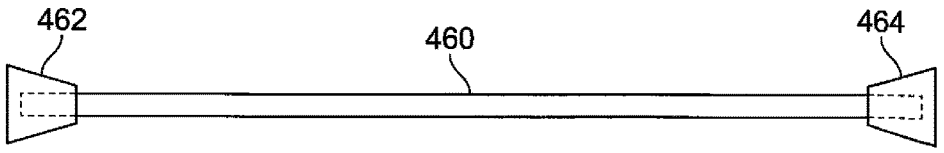
FIG. 4*b* is a top plan view of the embodiment in FIG. 4*a*.

A combination of a flyer bow and two end blocks is provided. The flyer bow is typically a flexible, convex, arcuate member that guides one or more wires along the length of the inside surface of the flyer bow. The flyer bow can be made of any material known to those skilled in the art to be suitable for use as a flyer bow. Flyer bows are commonly made of fiber-reinforced composite materials, including Carbon Fiber, Fiberglass, Glass KEVLAR® Carbon (or "GKC"), metals, or a combination of these. The end blocks have the features of the end blocks described above. FIGS. 4*a* and 4*b* show a combination of a flyer bow 460, and two end blocks 462 and 464, each attached to an end of flyer bow 460.

A method of securing a flyer bow to a wire twisting machine is provided, where the flyer bow has two end blocks, one at each end of the flyer bow, and the machine has two opposing wheels with an end block attached to each wheel. The method steps include slidably engaging an end block with a base, moving the end blocks apart, slidably engaging the other end block with the other base, and moving the end blocks together. The end blocks may be slidably engaged with their respective bases by cooperatively wedging the end blocks with the bases. If a base contains an opening and the end block to be inserted into the base contains a notch as described above, before the step of slidably engaging the end block with its respective base, the end block is first aligned with the base to allow the end block and the base to clear each other and the end block is inwardly inserted into the base. Optionally, an end block may be physically blocked from moving backwards in relation to the base. This step may include rotating a plate relative to a base to physically block the end block from moving backwards relative to the base.

Figure 5A:
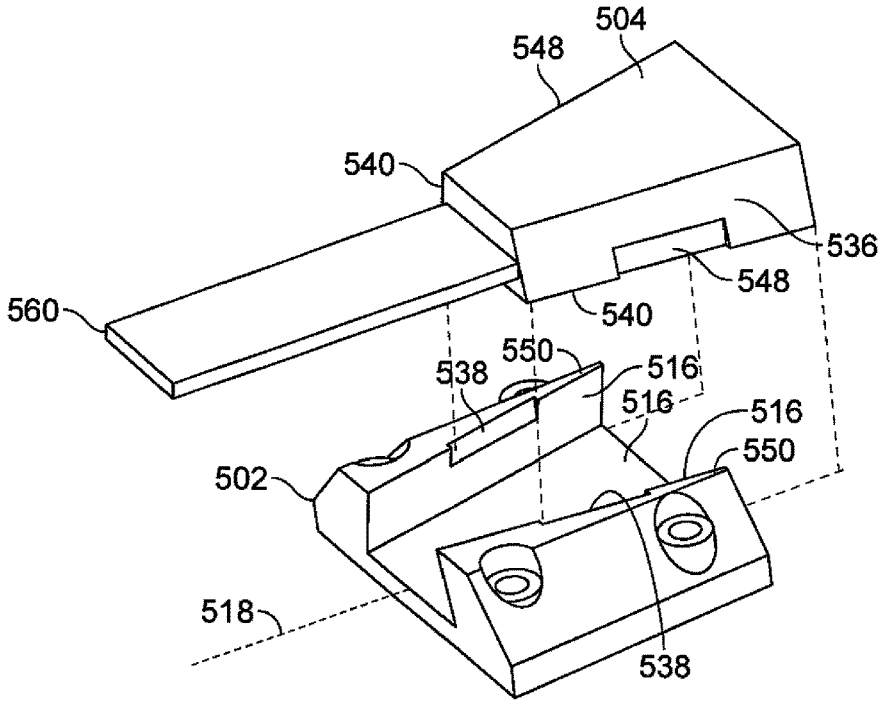
FIG. 5*a* is a perspective view of an end of a flyer bow attached to a first end block of the embodiment of FIG. 1 that is aligned with a first base of the embodiment of FIG. 1 for inward insertion of the first end block into the first base.

In FIGS. 5*a*-FIG. 6*c*, a flyer bow 560 is provided having a first end block 504 and a second end block 604, each end block attached to an end of the flyer bow 560. A wire twisting machine comprises a first wheel and a second wheel (not shown), the first and second wheels located on opposing sides of the machine, a first base 502 attached to the first wheel and a second base 602 attached to the second wheel. FIG. 5*a* shows first end block 504 is aligned with base 502.

Figure 5B:
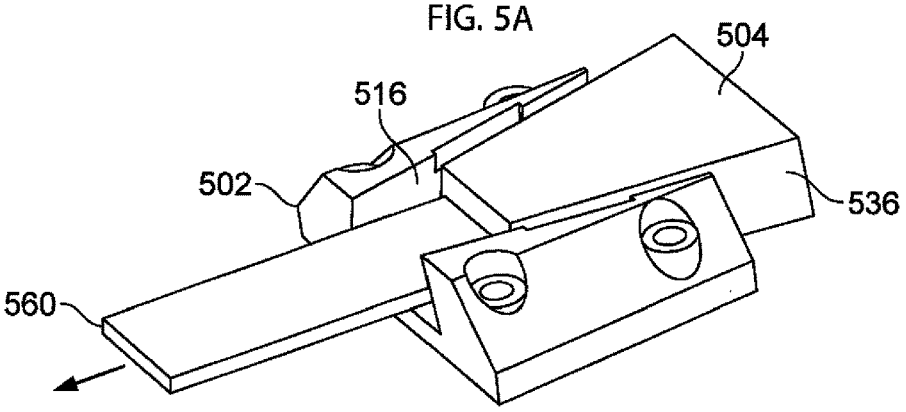
FIG. 5*b* is a perspective view of an end of a flyer bow attached to a first end block of the embodiment of FIG. 1 that has been inwardly inserted into a first base of the embodiment of FIG. 1, where the opening of the first base clears the first end block and the notch of the first end block clears the first base.
Figure 5C:
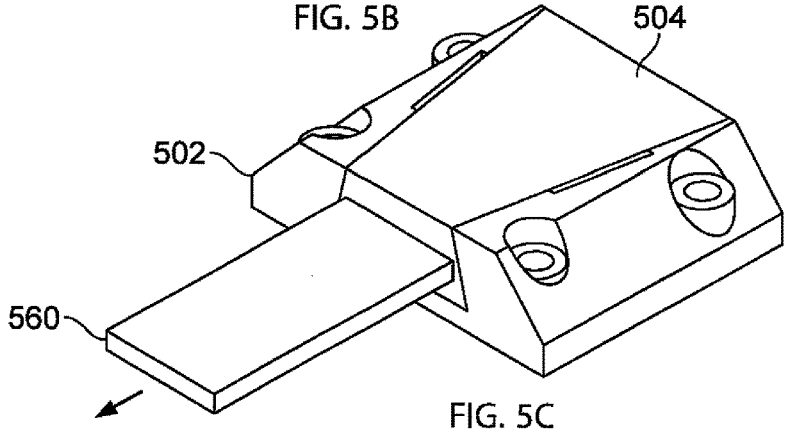
FIG. 5*c* is a perspective view of an end of a flyer bow attached to a first end block of the embodiment of FIG. 1, where the first end block has been slidably engaged and cooperatively wedged with a first base of the embodiment of FIG. 1.
Figure 5D:
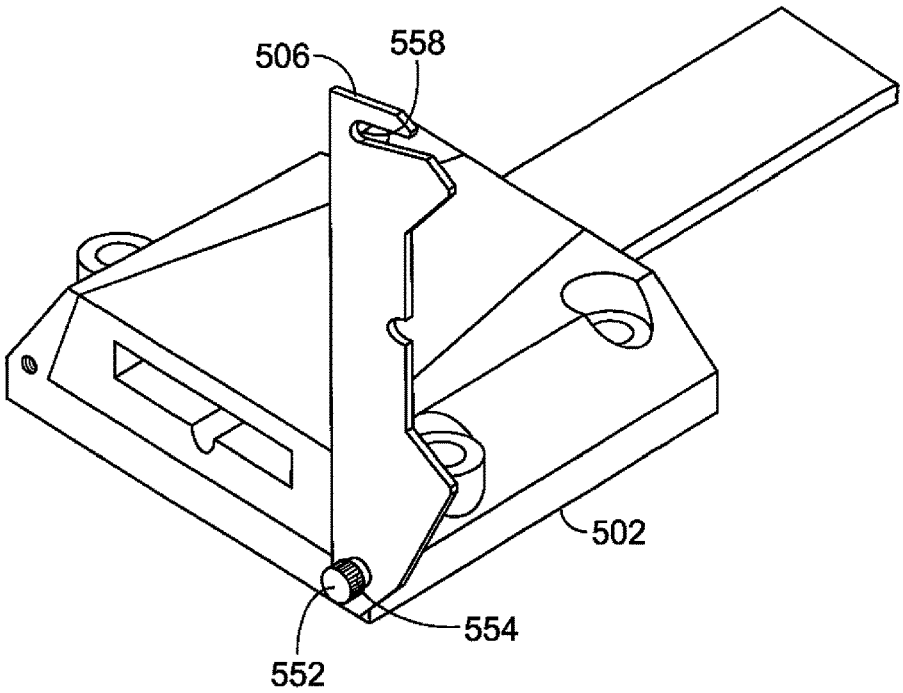
FIG. 5*d* is a perspective view of an end of a flyer bow attached to a first end block slidably engaged and cooperatively wedged with a first base of the embodiment of FIG. 1, and a first plate has been rotatably coupled to the base at a first position of the first plate.
Figure 5E:
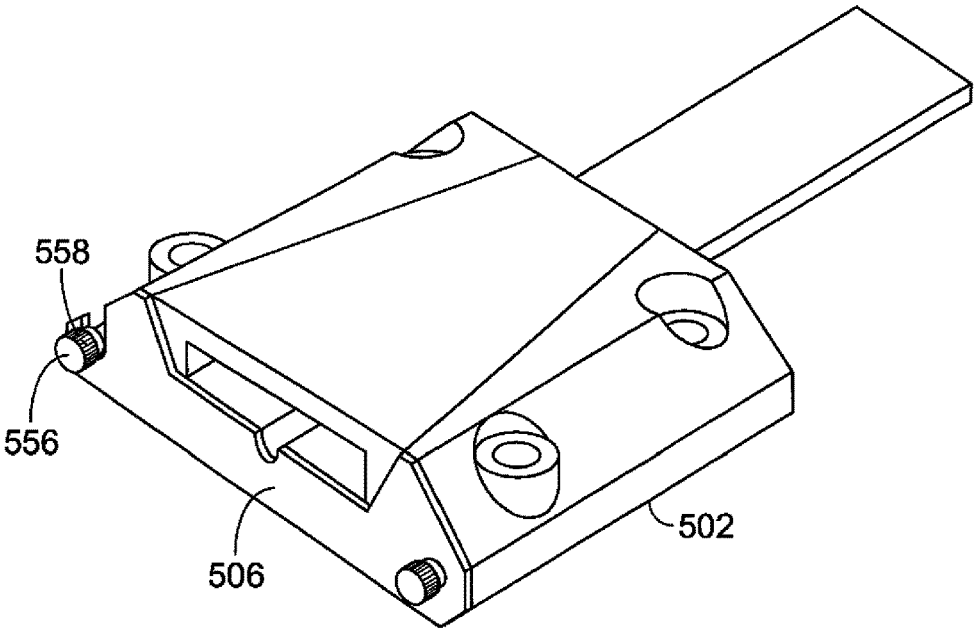
FIG. 5*e* is a perspective view of an end of a flyer bow attached to a first end block slidably engaged and cooperatively wedged with a first base of the embodiment of FIG. 1, a first plate has been rotatably coupled to the base and secured to the base at a second position of the first plate.
Figure 6A:
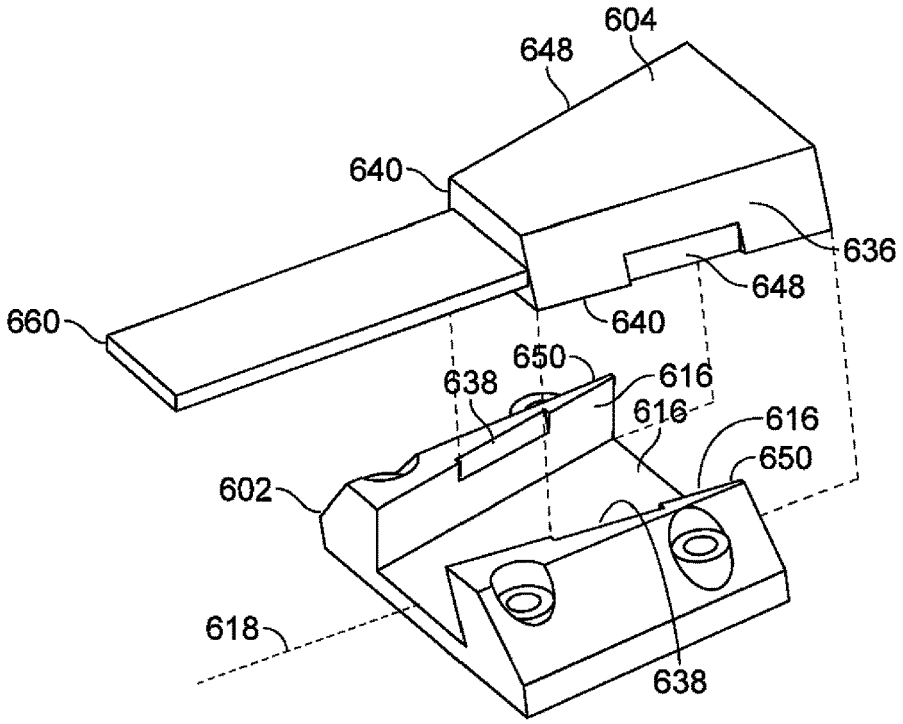
FIG. 6*a* is a perspective view of an end of a flyer bow attached to a second end block of the embodiment of FIG. 1 that is aligned with a second base of the embodiment of FIG. 1 for inward insertion of the second end block into the second base.
Figure 6B:
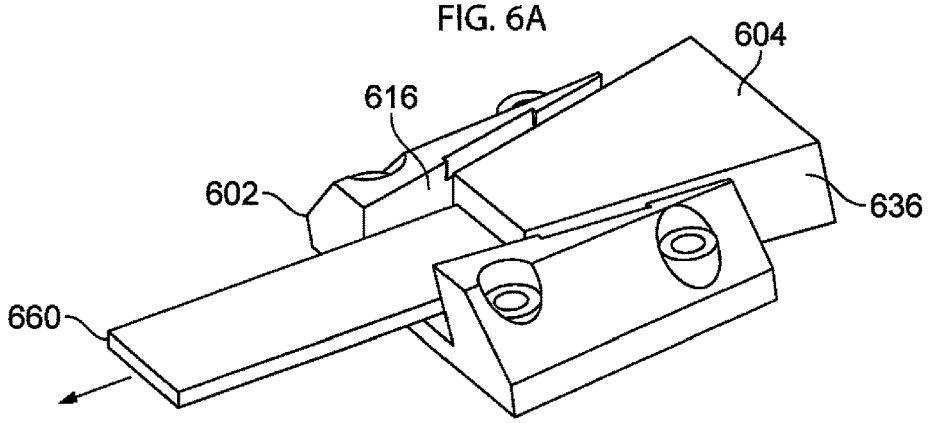
FIG. 6*b* is a perspective view of an end of a flyer bow attached to a second end block of the embodiment of FIG. 1 that has been inwardly inserted into a second base of the embodiment of FIG. 1, where the opening of the second base clears the second end block and the notch of the second end block clears the second base.
Figure 6C:
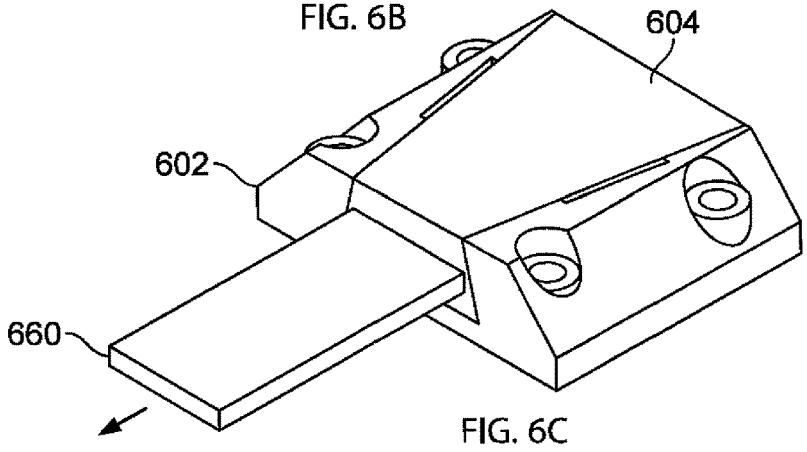
FIG. 6*c* is a perspective view of an end of a flyer bow attached to a second end block of the embodiment of FIG. 1 where the second end block has been slidably engaged and cooperatively wedged with a second base of the embodiment of FIG. 1.
Figure 6D:
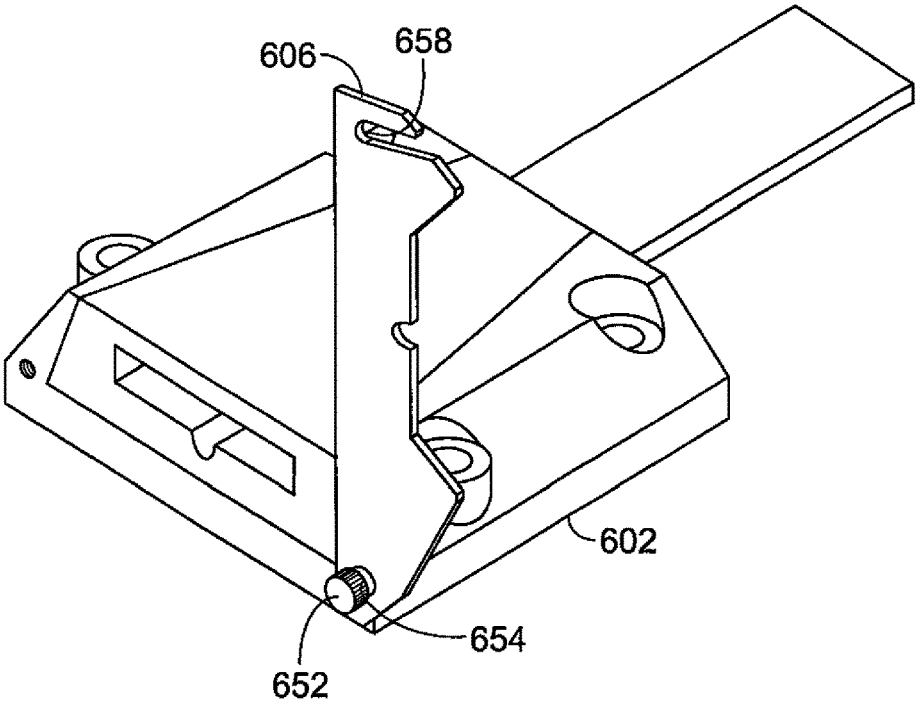
FIG. 6*d* is a perspective view of an end of a flyer bow attached to a second end block slidably engaged and cooperatively wedged with a second base of the embodiment of FIG. 1, and a second plate has been rotatably coupled to the base at a first position of the second plate.
Figure 6E:
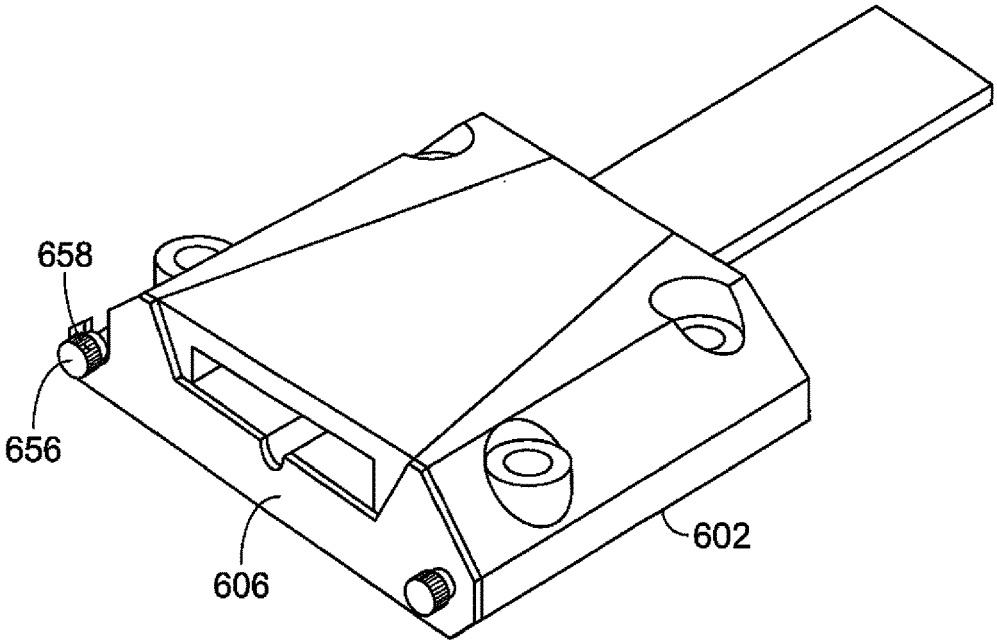
FIG. 6*e* is a perspective view of an end of a flyer bow attached to a second end block slidably engaged and cooperatively wedged with a second base of the embodiment of FIG. 1, a second plate has been rotatably coupled to the base and secured to the base at a second position of the second plate.

Along longitudinal axis 518, portion 540 of end block 504 is aligned with opening 538 of base 502, and notch 548 of end block 504 is aligned with portion 550 of base 502. First end block 504 is then inwardly inserted into base 502, as shown in FIG. 5*b*. As shown in FIG. 5*c*, first end block 504 moves in the forward direction with respect to base 502 (as shown in the direction of the arrow), recess engagement portion 536 of end block 504 slidably engages and cooperatively wedges with recess 516 of base 502. In FIG. 5*d*, first plate 506 is rotatably coupled to base 502 using screw 552 located at a first position 554 of the first plate 506. In FIG. 5*e*, first plate 506 is then secured to first base 502 with screw 556 at second position of the first plate 558. Second end block 604 is then moved apart from first end block 504 and base 502 by flexing and straightening flyer bow 560 so that it extends towards second base 602. Second end block 604 is then aligned with second base 602. Along longitudinal axis 618, portion 640 of second end block 604 is aligned with opening 638 of second base 602 and notch 648 is aligned with portion 650 of second base 602. Second end block 604 is then inwardly inserted into second base 602. As second end block 604 moves in the forward direction with respect to base 602, recess engagement portion 636 of end block 604 slidably engages with, and cooperatively wedges with, recess 616 of base 602. In FIG. 6*d*, second plate 606 is rotatably coupled to second base 602 using screw 652 located at a first position 654 of the second plate 606. Second plate 606 is then rotated relative to the second base 602 about the first position of second plate 606 at hole 654, and is then secured to second base 602 with screw 656 through at a second position 658 of the second plate.

A method for attaching an end block to an end of a flyer bow is provided. The method steps include providing a flyer bow and an end block, applying an adhesive to one or both of the end and flyer bow, and allowing the adhesive to bond the flyer bow and the end block.

The foregoing description illustrates only certain preferred embodiments of the invention. The invention is not limited to the foregoing examples. That is, persons skilled in the art will appreciate and understand that modifications and variations are, or will be, possible to utilize and carry out the teachings of the invention described herein. Accordingly, all suitable modifications, variations and equivalents are intended to fall within the scope of the invention as described and within the scope of the claims. A broad purposive construction of the claim elements is intended. Although specific examples of materials, cross sectional profiles of longitudinal recesses, openings and stops are provided in the foregoing description, it is not intended to limit the construction to those specific materials and features but any materials and features having those general properties should be considered to be encompassed.

The invention claimed is:

1. A system for securing a flyer bow to a wheel of a wire twisting machine, the wheel having an outer surface and a rotational axis, the system comprising:

a base having a front side, a back side, an inner side, and an outer side, the outer side comprising a longitudinal recess, the center of the width of the recess defining a longitudinal axis, the recess comprising:

an inner lateral dimension and an outer lateral dimension, the inner lateral dimension being greater than the outer lateral dimension, and a front lateral dimension and a rear lateral dimension, the front lateral dimension being smaller than the rear lateral dimension; and an end block attachable to the end of the flyer bow, the end block comprising a recess engagement portion disposed to slidably engage the longitudinal recess;

wherein the base is sized for fixing to the outer surface of the wheel;

wherein the longitudinal axis of the recess and the rotational axis of the wheel are substantially coplanar; and wherein when the end block is attached to the end of the flyer bow and used to secure the flyer bow to the wheel of the wire twisting machine, the recess engagement portion is cooperatively engaged within the longitudinal recess to distribute forces acting in forward and lateral directions over a contact surface between the end block and the base, and wherein:

the outer side of the base further comprises an opening:

extending inwardly from the outer side of the base and laterally from the longitudinal recess of the base, and spaced away from the front side of the base along the longitudinal axis;

the end block and the opening are sized to allow at least a portion of the end block to clear the opening when that portion of the end block is aligned with the opening, for inward insertion of the end block into the base or outward removal of the end block from the base.

2. The system of claim 1 wherein the recess engagement portion is disposed to cooperatively wedge within the longitudinal recess in the longitudinal direction.

3. The system of claim 1 wherein the cross sectional profile of the longitudinal recess along the longitudinal axis forms a dovetail shape.

4. The system of claim 1, wherein the opening is located between the front side of the base and the back side of the base; the end block further comprises a front side, a back side, an inner side, an outer side and a notch located between the front side and the back side of the end block, the notch sized to allow at least a portion of the base between the back side of the base and the opening to clear the notch when that portion of the base is aligned with the notch, for inward insertion of the end block into the base or outward removal of the end block from the base.

5. A method for attaching an end block to an end of a flyer bow, the method comprising:

providing a flyer bow;

providing an end block of claim 1;

applying adhesive to one or both of the end block and the end of the flyer bow;

contacting the end block and the flyer bow; and allowing the adhesive to bond the flyer bow and the end block.

6. A system for securing a flyer bow to a wheel of a wire twisting machine, the wheel having an outer surface and a rotational axis, the system comprising:

a base having a front side, a back side, an inner side, and an outer side, the outer side comprising a longitudinal recess, the center of the width of the recess defining a longitudinal axis, the recess comprising:

an inner lateral dimension and an outer lateral dimension, the inner lateral dimension being, greater than the outer lateral dimension, and a front lateral dimension and a rear lateral dimension, the front lateral dimension being smaller than the rear lateral dimension; and an end block attachable to the end of the flyer bow, the end block comprising a recess engagement portion disposed to slidably engage the longitudinal recess;

wherein the base is sized for fixing to the outer surface of the wheel;

wherein the longitudinal axis of the recess and the rotational axis of the wheel are substantially coplanar; and wherein when the end block is attached to the end of the flyer bow and used to secure the flyer bow to the wheel of the wire twisting machine, the recess engagement portion is cooperatively engaged within the longitudinal recess to distribute forces acting in forward and lateral directions over a contact surface between the end block and the base, the system further comprising a stop removeably attached to the base, wherein the stop physically blocks the end block from moving backward relative to the base when the stop is attached to the base and the recess engagement portion is engaged with the longitudinal recess, and wherein the recess engagement portion is disengageable from the longitudinal recess when the stop is detached from the base.

7. The system of claim 6 wherein the stop comprises a plate rotatably coupled to the base at a first position of the plate and is attachable to the base at a second position of the plate.

8. In combination, a flyer bow and two end blocks, each end block attached to an end of the flyer bow for securing the end of the flyer bow to a base fixed to a wheel of a wire twisting machine, each wheel having an outer surface and a rotational axis, each base having a front side, a back side, an inner side, and an outer side, the outer side comprising a longitudinal recess, the center of the width of the recess defining a longitudinal axis, the recess comprising an inner lateral dimension and an outer lateral dimension, the inner lateral dimension being greater than the outer lateral dimension, a front lateral dimension and a rear lateral dimension, the front lateral dimension being smaller than the rear lateral dimension, the base is sized and fixed to the outer surface of the wheel such that the longitudinal axis of the recess and the rotational axis of the wheel are substantially coplanar, wherein:

each end block comprises a recess engagement portion disposed to slideably engage the longitudinal recess of a base; and wherein when each end block is used to secure the flyer bow to the wheel of the wire twisting machine, the recess engagement portion is cooperatively engaged within the longitudinal recess to distribute forces acting in forward and lateral directions over a contact surface between the end block and the base, and wherein the opening of each base is located between the front side of the base and the back side of the base; each end block further comprises a front side, a back side, an inner side, an outer side and a notch located between the front side and the back side of the end block, the notch sized to allow at least a portion of the base between the back side of the base and the opening to clear the notch for inward insertion of the end block in the base and outward removal of the end block from the base when that at least one portion of the base is aligned with the notch.

9. The flyer bow of claim 8 wherein each end block is disposed to cooperatively wedge within the longitudinal recess of a base along the longitudinal axis of that base.

10. The flyer bow of claim 8 wherein the cross sectional profile of the longitudinal recess of each base forms a dovetail shape.

11. The flyer bow of claim 8, wherein:

the outer side of each base further comprises an opening:

extending toward the inner side and laterally from the longitudinal recess of the base, and spaced away from the front side of the base along the longitudinal axis; and each end block and each base is sized to allow at least a portion of the end block to clear the opening for outward removal of the end block from the base when that portion of the end block is aligned with the opening of the base.

12. A method of securing a flyer bow to a wire twisting machine, the wire twisting machine comprising a first wheel and a second wheel, the first and second wheels located on opposing sides of the machine, a first base attached to the first wheel and a second base attached to the second wheel, the flyer bow comprising a first end block attached to a first end of the flyer bow and a second end block attached to a second end of the flyer bow, the method steps comprising:

slidably engaging the first end block with the first base;

moving apart the second end block from the first end block and the first base;

slidably engaging the second end block with the second base; and moving together the second end block and the first end block, wherein when the flyer bow is rotated forces acting in forward and lateral directions on each end block and base are distributed over a contact surface between each end block and base, wherein each base comprises an opening to allow inward insertion of at least one part of an end block in the base and outward removal of at least one part of the end block from the base, and each end block comprises a notch to allow the at least one part of the end block to be inwardly inserted in a base and outwardly removed from the base, the method further comprising:

before the step of slidably engaging the first end block with the first base, aligning the first end block with the first base so that the opening of the first base clears the first end block and the notch of the first end block clears the first base, inwardly inserting the first end block into the first base; and before the step of slidably engaging the second end block with the second base, aligning the second end block with the second base so that the opening of the second base clears the second end block and the notch of the second end block clears the second base, and inwardly inserting the second end block into the second base.

13. The method of claim 12 farther comprising:

during the step of slidably engaging the first end block with the first base, cooperatively wedging the first end block with the first base; and during the step of slidably engaging the second end block with the second base, cooperatively wedging the second end block with the second base.

14. The method of claim 12 further comprising:

after the step of slidably engaging the first end block with the first base, physically blocking the first end block from moving away from the centre of the machine; and after the step of slidably engaging the second end block with the second base, physically blocking the second end block from moving away from the centre of the machine.

15. A method of securing a flyer bow to a wire twisting machine, the wire twisting machine comprising a first wheel and a second wheel, the first and second wheels located on opposing sides of the machine, a first base attached to the first wheel and a second base attached to the second wheel, the flyer bow comprising a first end block attached to a first end of the flyer bow and a second end block attached to a second end of the flyer bow, the method steps comprising:

slidably engaging the first end block with the first base;

moving apart the second end block from the first end block and the first base;

slidably engaging the second end block with the second base;

moving together the second end block and the first end block, wherein when the flyer bow is rotated forces acting in forward and lateral directions on each end block and base are distributed over a contact surface between each end block and base;

after the step of slidably engaging the first end block with the first base, physically blocking the first end block from moving away from the centre of the machine; and after the step of slidably engaging the second end block with the second base, physically blocking the second end block from moving away from the centre of the machine, wherein:

the step of physically blocking the first end block from moving away from the centre of the machine comprises:

rotatably coupling a first plate to the first base at a first position, rotating the first plate relative to the first base about the first position, and securing the first plate relative to a second position of the first base, and the step of physically blocking the second end block from moving away from the centre of the machine comprises:

rotatably coupling a second plate to the second base at a first position of the second base, rotating the second plate relative to the second base about the first position of the second base, and securing the second plate relative to a second position of the second base.

* * * * *